United States Patent [19]

Vogt

[11] Patent Number: 4,723,469

[45] Date of Patent: Feb. 9, 1988

[54] FRET FOR THE FINGERBOARD OF PLUCKED STRINGED INSTRUMENTS

[76] Inventor: Walter J. Vogt, Pfarrer-Egen-Weg 11, D-7240 Horb-Mühlen, Fed. Rep. of Germany

[21] Appl. No.: 30,380

[22] Filed: Mar. 26, 1987

[51] Int. Cl.[4] ..... G10D 3/06

[52] U.S. Cl. ..... 84/314 R

[58] Field of Search ..... 84/314

[56] References Cited

U.S. PATENT DOCUMENTS 3,273,439 9/1966 Keefe et al. ..... 84/314 R
3,712,952 1/1973 Terlinde ..... 84/314 R
4,620,470 11/1986 Vogt ..... 84/314 R

FOREIGN PATENT DOCUMENTS 3413765 10/1985 Fed. Rep. of Germany .... 84/314 R

*Primary Examiner*—Lawrence R. Franklin
*Attorney, Agent, or Firm*—Laubscher & Laubscher

[57] ABSTRACT

A fret for the fingerboard of a plucked stringed instrument, in particular, a guitar, comprises a metal body including on its side facing the string a structural groove extending parallel to the longitudinal axis of the fret. A plastic or metal insert into which the fingered string presses slightly so as to be held stationarily and prevented from "whizzing" is replaceably inserted into this structural groove.

5 Claims, 6 Drawing Figures

FRET FOR THE FINGERBOARD OF PLUCKED STRINGED INSTRUMENTS

BACKGROUND OF THE INVENTION

The invention relates to a fret for the fingerboard of plucked stringed instruments, in particular, guitars, with a metal body attached to the fingerboard.

The known frets of this kind consist of metal throughout. To produce a tone of a certain pitch on the instrument, the string is pressed downwardly with the finger against the fingerboard as closely as possible to the fret so that the string comes to rest against the upper metal edge of the fret.

Recent research indicates that if the string is not pressed immediately adjacent to the fret, but at some distance away, it is not immovably fixed at the fret edge, but moves back and forth on the smooth, flat edge while it vibrates. This may impair the characteristic sound of the tone in question and result in the unpleasant, so-called "whirr" or "whizz" effect. Since it is not possible to press the string immediately adjacent to the fret on account of the anatomical structure of the human hand, particularly in difficult finger positions, this whirring or whizzing of the string and the tone produced by it has heretofore had to be tolerated. In the course of time, the frets become worn down by the vibrating strings and must be renewed. This is a complicated procedure.

SUMMARY OF THE INVENTION

The object of the invention is to overcome these shortcomings and to so improve a generic fret for plucked stringed instruments that whirring or whizzing of the string pressed against it is eliminated and the fret is easily renewed.

The object is attained, in accordance with the invention, by the metal body of the fret comprising on its side facing the string a structural groove extending parallel to the longitudinal axis of the fret, and by a metal or plastic insert being inserted into this groove.

It has been ascertained that as the string is pressed against the insert which is preferably softer and elastically resilient in comparison with the metal body, a slight indentation is made therein in which the string is fixed and cannot slide sidewardly. This eliminates the annoying whirring or whizzing, more particularly, even if the string is pressed at some distance from the fret and is thereby urged with less force against the upper side of the fret. A worn insert can be easily removed from the metal body and replaced by a new insert without having to remove the entire metal body from the fingerboard of the guitar.

BRIEF DESCRIPTION OF THE FIGURES

The invention is explained in further detail in the following description of preferred embodiments with reference to the appended drawings.

DETAILED DESCRIPTION

Figure 1:
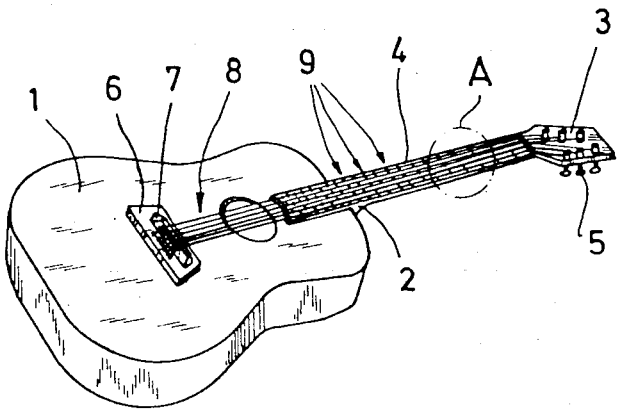
FIG. 1 shows a perspective view of a guitar.

The guitar illustrated in FIG. 1 as an example of a plucked stringed instrument consists, in a known manner, of a sound box 1, with a neck 2 protruding therefrom. The neck 2 is connected at its free end to a pegboard 3. Arranged on the neck 2 is a fingerboard 4 (usually black) which extends partly across the sound box 1. Six strings 8 which can be tuned at various pitches with the aid of the pegs 5 are stretched between the pegs 5, rotatably mounted on the pegboard 3, and a string holder 6 with a bridge 7. Arranged on the fingerboard 4—see also FIG. 2—are ridge-type frets 9 which extend transversely to its longitudinal extension and protrude upwardly towards the strings 8. When the instrument is being played, the tone of each string 8 can be varied (made higher) by pressing the string 8 against one of the frets 9 and thereby shortening the effective string length.

Figure 3:
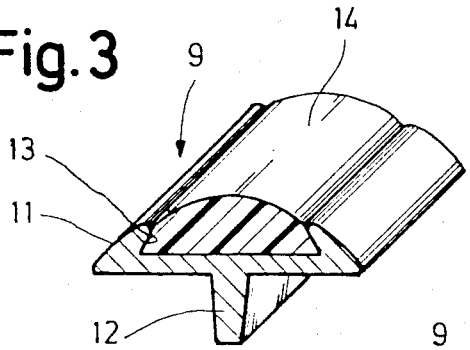
FIG. 3 shows a sectional view of a fret with a plastic insert.

FIG. 3 shows the structure of a fret 9. The fret consists of a metal body 11 with a foot 12 protruding downwardly therefrom. The metal body 11 is inserted by means of the foot into a corresponding groove in the fingerboard 4. On its upper side facing the string 8, the fret comprises a structural groove 13 extending parallel to its longitudinal axis. The structural groove may, for example, be of dovetail cross-sectional shape with inside flanks extending at an incline to the bottom of the groove. Inserted into the structural groove 13 is an insert 14 made of plastic, for example, nylon or macrolon (both registered trademarks). The outer cross-sectional shape of the insert 14 and the inner cross-sectional shape of the structural groove 13 are complementary. The insert 14 can be snapped into the groove 13 from above or pushed in from the side using pressure. In this way, the insert 14 is, on the one hand, held firmly in the structural groove 13, but, on the other hand, can be easily removed and replaced.

The hardness of the plastic forming the insert 14 is so selected that a small indentation which prevents the string from drifting to the side is made in the insert by the string when pressed against it. The plastic must be sufficiently elastic for the indentation on the insert to disappear again when the string is released. The plastic forming the insert 14 must not be so soft that the indentation caused by the string pressing against it is so deep that the metal body 11 comes into contact with the string. The plastic material must, of course, not be so hard that an indentation is not made when the string is pressed against it.

As is apparent from the drawings, the insert 14 is curved on its upper side so that the depressed string rests on a rounded-off edge.

Figure 4:
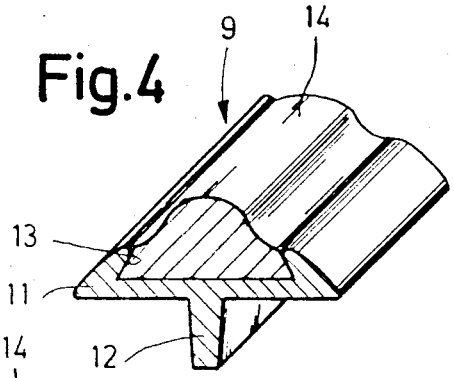
FIG. 4 shows a sectional view of a further embodiment of the fret with a metal insert.

Material, hardness, cross-sectional shape and height of the insert 14 are variable. This enables adaptation of the frets 9 to the peculiarities of the players. At the same time, different sound effects can in this way be produced. FIG. 4 shows, in comparison with FIG. 3, an embodiment of a fret 9 wherein the insert 14 is of higher construction and has a smaller radius of curvature at its upper edge. The insert 14 shown in FIG. 4 consists of metal, but it could also be made of plastic.

Figure 5:
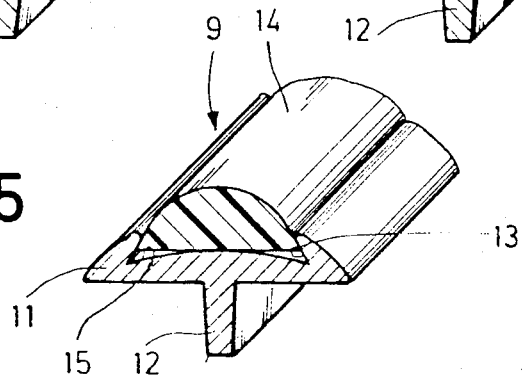
FIG. 5 shows yet another embodiment of the fret.

In the embodiment shown in FIG. 5, the bottom 15 of the structural groove 13 formed in the metal body 11 is curved transversely to the longitudinal axis of the fret 9 upwardly towards the plastic insert 14. The insert which has a flat underside is, therefore, always in contact with the metal body 11 approximately at the center of the groove bottom 15 above the foot 12. This ensures good sound transmission from the string 8 to the sound box 1 of the plucked instrument via the fret 9. Without the curvature of the groove bottom 15, the insert 14 could become so deformed when pressed into the structural groove 13 that it rises off the groove bottom at its cross-sectional center, which could impair the sound transmission.

Figure 6:
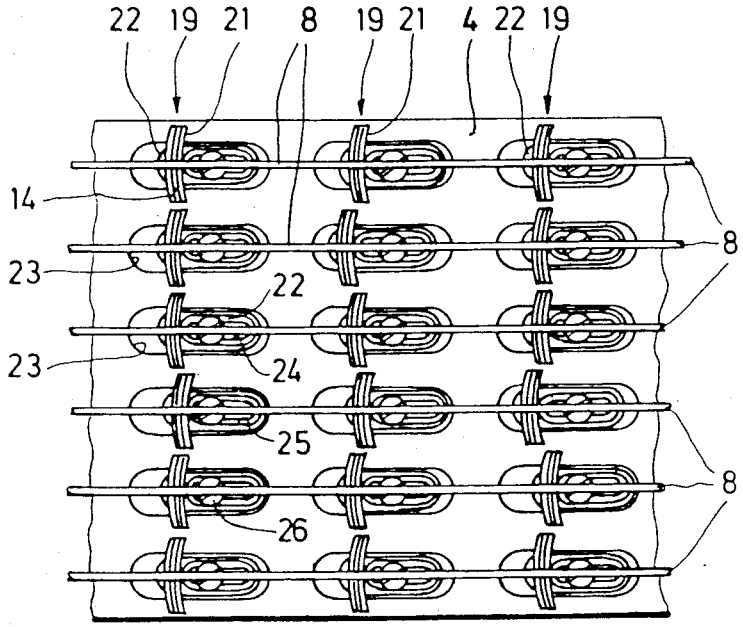
FIG. 6 shows a partial view of a fingerboard with frets consisting of single elements.
Figure 2:
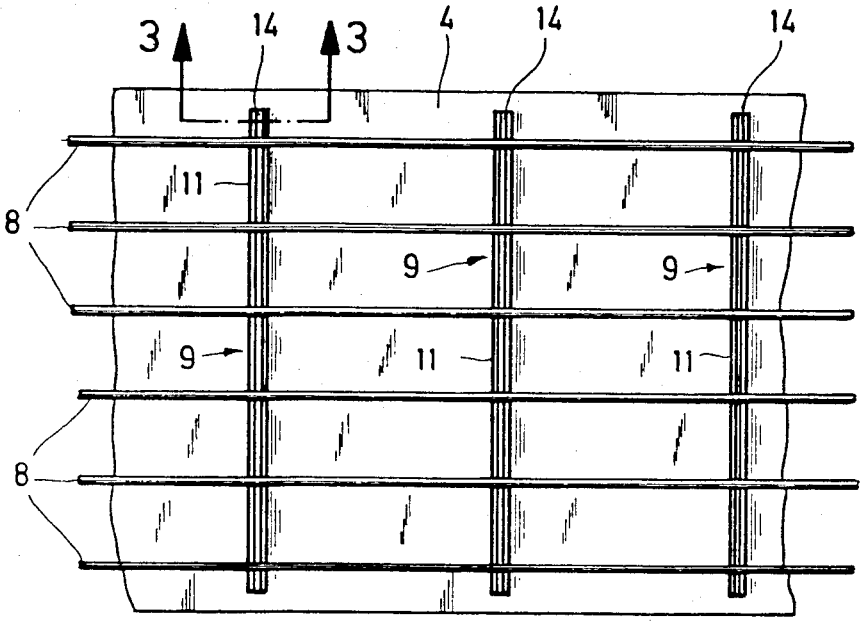
FIG. 2 shows area A of FIG. 1.

Finally, FIG. 6 shows a fingerboard 4 wherein the continuous frets 9 shown in FIG. 2 are divided up into single fret elements 19 which are separately adjustable and fixable on the fingerboard 4 in the longitudinal direction of the strings 8. Each fret element 19 comprises a curved, comparatively short, transverse ridge 21 on which the string 8 rests when the pertinent note is struck. The transverse ridge 21 is rigidly connected to an elongate slider 22 which is slideably displaceably arranged in a groove 23 extending in the longitudinal direction of the fingerboard 4. Each slider 22 comprises an elongate hole 24 which is encircled by a stepped shoulder 25. A screw 26 which is screwed into a threaded bush arranged in the fingerboard 4 extends through the elongate hole 24 perpendicularly to the fingerboard 4. When the screw 26 is slackened, the slider 22 and with it the transverse ridge 21 can be set in accordance with a desired pitch. The fret element 19 is fixed at the set pitch by tightening the screw 26.

The single fret elements 19 have the same structure as shown in FIGS. 3, 4 and 5, i.e., they similarly each consist of a metal body 11 which is connected to the slider 22 and has a structural groove 13 into which the plastic insert 14 is inserted.

The following advantages are gained from the inventive construction of the fret 9 or the fret elements 19: A soft, clear and pleasant sound is obtained as the strings of the instrument do not whirr or whizz. The strings do not have to be fingered immediately adjacent to the fret, as heretofore, in order to obtain a perfect sound. Since the strings rest fixedly on the associated fret, perfect sound patterns are also produced when the strings are pressed some distance away from the frets. It is, for example, possible to regulate individual strings within the sound pattern by different degrees of hardness of the plastic material used for the inserts 14. Replacement of worn plastic inserts 14 does not involve any special effort. Different height and cross-sectional shape of the plastic inserts 14 may further influence the sound pattern of the individual instrument. This gives the player the opportunity to take his own particular wishes into consideration.

The main advantage of the invention is, however, that the fingered string presses slightly into the plastic insert 14 and is thereby prevented from "whizzing".

The inventive frets and fret elements may also be used in bowed stringed instruments insofar as frets are provided on the fingerboard, as, for example, in the violoncello.

The above remarks pertain to inserts 14 made of plastic which, on the one hand, prevent whirring or whizzing of the strings and, on the other hand, are easily replaceable when worn down by the vibrating strings without the entire fret 9 having to be removed from the fingerboard and replaced by a new one. Inserts 14 made of plastic are best suited for strings which are similarly made of plastic.

For strings which are made of metal, in particular, steel and, as a rule, are more strongly tensioned than plastic strings, it is recommendable to make the insert 14 out of metal, and not out of plastic, although hard plastics are, in principle, also suitable for the manufacture of the inserts 14 used for metal strings. On account of their stronger tension, metal strings, in particular, steel strings, have intrinsically a lesser tendency to produce the whirring or whizzing effect that the plastic strings so that the metal strings need not press so pronouncedly into the inserts 14 as the plastic strings.

On the other hand, the metal strings wear the inserts 14 down to a much greater extent that the plastic strings whose tension is usually weaker. In this case, the merits of the further feature of these inserts 14 that they are easily removed and replaced by new inserts make themselves evident. The inserts 14 consisting of plastic or metal can be snapped into the structural grooves from above or pushed into these grooves from the side and held in place by friction.

This results in the great advantage that the metal body 11 of the fret 9 need not be released from the fingerboard, which requires very skillful manipulation and often also causes damage to the fingerboard. The metal body 11 can be left on the fingerboard and only the insert 14 needs to be replaced.

The metal body 11 is usually made of nickel silver or a similar metal which on account of its softness fits snugly onto the fingerboard 4 of the guitar. If an insert 14 consisting of metal is used, a large variety of metals is suitable and can be selected, for example, in accordance with the desired sound and the required wear-resistance. Nickel silver, copper, titanium, iron (steel) or alloys thereof are, for example, suitable.

What is claimed is:

1. A fret for the fingerboard of a stringed musical instrument such as a guitar, comprising (a) a metal body containing a groove in the upper surface thereof facing the strings of the musical instrument, said groove having a dovetail cross section, the bottom portion of said groove being curved upwardly transversely to the longitudinal axis of the fret; and (b) an insert formed of one of a metal or plastic material, said insert being inserted into said groove and facing the instrument strings.

2. A fret as defined in claim 1, wherein the metal body with its groove runs in a straight line in the longitudinal direction of the fret.

3. A fret as defined in claim 1, wherein the metal body with its structural groove is in the form of a short ridge and is curved in the longitudinal direction of the fret.

4. A fret as defined in claim 1, wherein the metal body is inserted into the fingerboard by means of a protruding foot.

5. A fret as defined in claim 1, wherein the insert is replaceably inserted into the dovetail groove of the metal body.

* * * * *